US009714385B2

(12) United States Patent
Khan et al.

(10) Patent No.: US 9,714,385 B2
(45) Date of Patent: Jul. 25, 2017

(54) PROCESS FOR THE CONVERSION OF LOW POLYMER WAX TO PARAFFIN WAX, MICROCRYSTALLINE WAX, LUBE AND GREASE BASE STOCKS USING ORGANIC PEROXIDES OR HYDROPEROXIDES AND METAL OXIDES

(71) Applicants: Council of Scientific & Industrial Research, New Delhi (IN); Gail (India) Limited, New Delhi (IN)

(72) Inventors: Hayat Ullah Khan, Uttrakhand (IN); Manisha Sahai, Uttrakhand (IN); Sanat Kumar, Uttrakhand (IN); Ajay Kumar, Uttrakhand (IN); Gananath Doulat Thakre, Uttrakhand (IN); Savita Kaul, Uttrakhand (IN); Shrikant Madhusudan Nanoti, Uttrakhand (IN); Bal Mukand Shukla, Uttrakhand (IN); Madhukar Onkarnath Garg, Uttrakhand (IN); Paulose Anthony Thrissokaran, Noida (IN); Ajit Kumar Chaturvedi, Noida (IN)

(73) Assignee: COUNCIL OF SCIENTIFIC & INDUSTRIAL RESEARCH, Gail (IN)

( * ) Notice: Subject to any disclaimer, the term of this patent is extended or adjusted under 35 U.S.C. 154(b) by 0 days.

(21) Appl. No.: 14/974,906

(22) Filed: Dec. 18, 2015

(65) Prior Publication Data

US 2016/0194562 A1 Jul. 7, 2016

(30) Foreign Application Priority Data

Jan. 7, 2015 (IN) ..... 55/DEL/2015

(51) Int. Cl.
*C10G 1/00* (2006.01)
*C10G 1/10* (2006.01)
(Continued)

(52) U.S. Cl.
CPC ..... *C10G 1/10* (2013.01); *C10G 73/00* (2013.01); *C10L 3/00* (2013.01); *C10L 3/06* (2013.01);
(Continued)

(58) Field of Classification Search
CPC ..... C10G 1/00
(Continued)

(56) References Cited

U.S. PATENT DOCUMENTS 2,933,536 A 4/1960 Wall et al.
6,822,126 B2 11/2004 Miller
(Continued)

FOREIGN PATENT DOCUMENTS

CA 2154799 A1 10/1991

*Primary Examiner* — Thuan D Dang
(74) *Attorney, Agent, or Firm* — Ohlandt, Greeley, Ruggiero & Perle, LLP

(57) ABSTRACT

The present invention relates to a process for the conversion of a low molecular weight polymeric byproduct obtained during production of high density polyethylene (HDPE), commonly known as low polymer wax (LPW) or polymer mud, into different products like different grades of paraffin wax, microcrystalline wax, lube and grease base stocks by a process comprising of thermal treatment in an inert atmosphere in the presence of organic peroxides or hydroperoxides and metal oxides. The end product depends upon the suitable selection of various process parameters like type of peroxides or hydroperoxides, metal oxides, temperature and duration of reaction.

9 Claims, 4 Drawing Sheets

Flow sheet for conversion of low polymer wax to waxes, base oil and grease base stocks

(51) Int. Cl.

| | |
|---|---|
| ***C10M 105/04*** | (2006.01) |
| ***C10G 73/00*** | (2006.01) |
| ***C10M 177/00*** | (2006.01) |
| ***C10L 3/00*** | (2006.01) |
| ***C10L 3/06*** | (2006.01) |
| ***C10M 107/02*** | (2006.01) |

(52) U.S. Cl.
CPC ..... *C10M 105/04* (2013.01); *C10M 107/02* (2013.01); *C10M 177/00* (2013.01); *C10M 2203/0206* (2013.01); *C10M 2205/163* (2013.01); *C10N 2220/082* (2013.01); *C10N 2250/10* (2013.01)

(58) Field of Classification Search
USPC ..... 585/241, 752
See application file for complete search history.

(56) References Cited

U.S. PATENT DOCUMENTS

| | | | |
|---|---|---|---|
| 8,664,458 | B2 | 3/2014 | Kumar et al. |
| 2012/0016169 | A1 | 1/2012 | Kumar |
| 2014/0046102 | A1 | 2/2014 | D'Amato et al. |

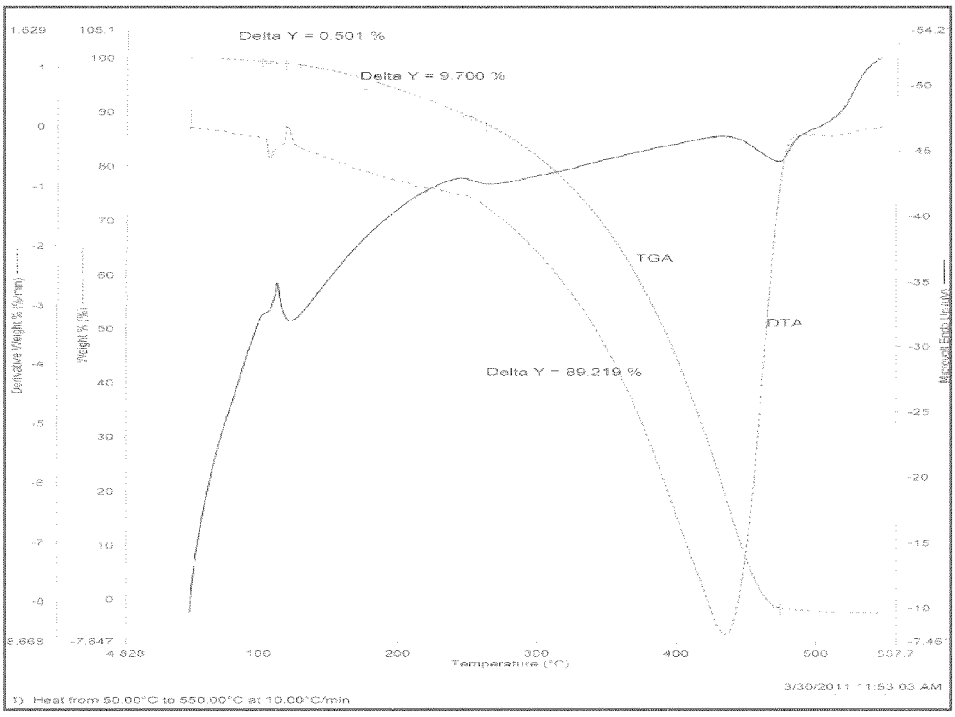
Figure 1 TGA analysis of Low Polymer Wax

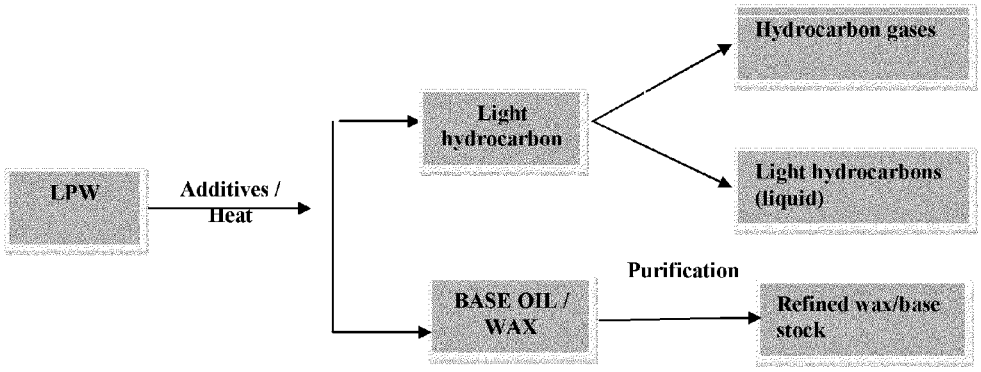
Figure 2. Flow sheet for conversion of low polymer wax to waxes, base oil and grease base stocks

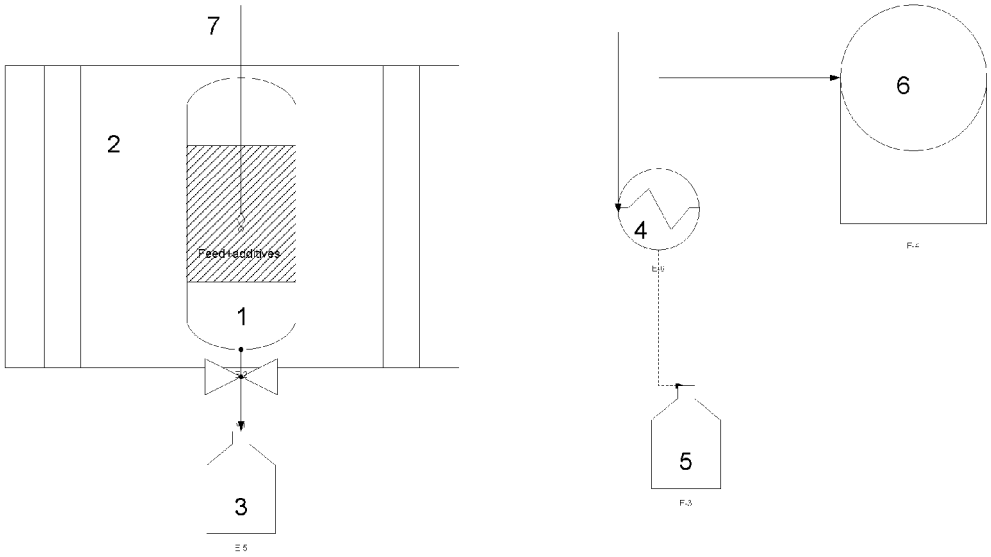
1. Reactor 2. Electrical Furnace 3. Product vessel 4. Condenser
5. Lighter liquid hydrocarbon vessel 6. Gas reservoir 7.Thermocouple
Figure 3. Schematic process flow sheet for conversion of low polymer wax to grease base stock

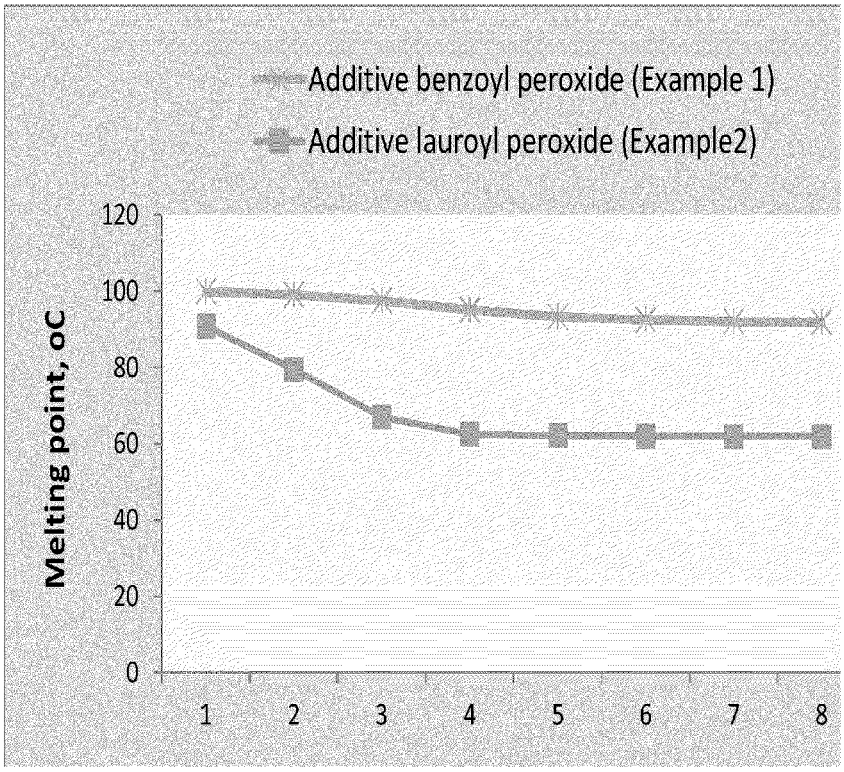
Figure 4: Effect of reaction time on melting point of degraded product as described in examples 1 & 2

PROCESS FOR THE CONVERSION OF LOW POLYMER WAX TO PARAFFIN WAX, MICROCRYSTALLINE WAX, LUBE AND GREASE BASE STOCKS USING ORGANIC PEROXIDES OR HYDROPEROXIDES AND METAL OXIDES

FIELD OF THE INVENTION

The present invention relates to a process for the conversion of low polymer wax to paraffin wax, microcrystalline wax, lube and grease base stocks using organic peroxides or hydro peroxides and metal oxides.

BACKGROUND OF THE PRIOR ART

During the production of high density polyethylene (HDPE) by certain processes e.g. slurry process, a significant quantity is obtained as an off specs low molecular weight (2000-50,000) polymer product commonly known as low polymer wax (LPW) or polymer mud. This low polymer wax is a low value product as it has limited applications and converting these into products like paraffin waxes, microcrystalline waxes, lube and grease base stocks would provide value addition to low polymer wax.

These low polymer waxes are low value products as their low molecular weight does not give them the mechanical strength required for polyethylene and the high melting point does not permit them to be used as substitutes for petroleum waxes. These being polyolefinic in nature do not degrade naturally and may be seen dumped into the factory backyard. Their disposal by land filling or incineration is hazardous to environment as land filling requires an enormous amount of land and results in several problems due to leaching and incineration on the other hand emits toxic gases. Hence for effective utilization of this product there is need for a suitable process that can convert it to useful products. A potential solution is to convert them to products like paraffin waxes or microcrystalline waxes which have multiple industrial and domestic uses or to products like base stocks which can be utilized to formulate lube oils and greases.

Some researchers have tried to convert this type of product into gasoline, diesel and aromatics.

Reference may be made to process developed by Khan et. al (Indian patent application no 0676 DEL 2010) wherein low polymer wax has been converted to gasoline, diesel and aromatics along with LPG by a process comprising of pyrolysis and vapour phase catalytic conversion using zeolite type catalysts. The drawback of this process is that the product is a hydrocarbon liquid having carbon number in the range of C5-C16 and as such waxes and base stocks which have a carbon number greater than 17 could not be obtained. The liquid fuel and aromatics which are produced by this process have different applications.

Reference may be made to the process developed by Eigo et. al (Patent CA 2154799 C, 2002) wherein a method is disclosed that comprises of pyrolysis of polymer in the presence of a higher fatty acid or a hydrochloric acid acceptor or both involving the steps of introducing a reaction mixture resulting from pyrolytic reaction of a polymer in a pyrolysis reactor into an evaporator connected to the pyrolysis reactor at a high temperature, causing the reaction mixture to evaporate in the evaporator while blowing an inert gas into the evaporator, withdrawing volatile components separated from the reaction mixture from the evaporator, and withdrawing the reaction mixture from the evaporator. When the polymer is an olefin polymer, by this method, a pyrolytic wax of quality having satisfactory hue and a minimal content of contaminants is continuously produced in a stable manner for a long period. The drawback of this process is the requirement of higher fatty acid or hycrochloric acid acceptor or both during pyrolysis.

Reference may be made to processes developed by Kumar Anil. (U.S. patent application Ser. No. 12/836,594; Publication no. US 2012/0016169 A1, 15$^{th}$ Jul. 2010 and Indian Patent application No. 0614/DEL/2010 wherein waxes or lubricating grease basestock is obtained from mixed waste plastic wastes like HDPE, LDPE, LLDPE by a process comprising of catalytic depolymerization. The mixed polyethylene waste is preheated to form a molten mixed polyethylene waste. Then depolymerization reaction of the molten mixed polyethylene waste is started. The depolymerization reaction uses a catalyst in a high pressure reactor at a desired temperature using heaters in the high pressure reactor. The catalyst is disposed on a stirring blade. Progression of depolymerization reaction of the molten mixed polyethylene waste is allowed to continue until a pressure in the high pressure reactor reaches a desired value. The heaters are turned off and depolymerization reaction of the molten mixed polyethylene waste is stopped upon the pressure in the reactor reaching desired value. The mixed polyethylene waste is converted to wax or grease base stock.

The drawback of the process is

- Requirement of high molecular weight polyethylene as feed stock
- Requirement of high temperature (up to 600° C.) and pressure (about 50 psig-350 psig)
- Synthesis of a specialty catalyst [Fe—Cu—Mo—P]/Al2O3.

Reference may be made to process developed by Miller (U.S. Pat. No. 6,822,126) wherein a waste or virgin plastics is converted by continuous process into lube oils. The plastic feed is maintained in a heater at preferred temperatures of 150-350° C. The feed is continuously passed to a pyrolysis reactor preferably maintained at a temperature of 450-700° C. and at atmospheric pressure. Relatively short residence times are employed. Optionally, the reactor effluent is processed in a hydrotreating unit. The effluent is fed to an isomerization dewaxing unit and fractionated to recover lube oil stocks. Preferably, the feed to the pyrolysis reactor can be a blend of waste plastic and waxy Fischer-Tropsch fractions. The drawback of the process is the requirement of hydrogen gas for hydro treating and isomerization dewaxing unit as well as high molecular weight polyethylene and Fischer Tropsch waxes as feedstock.

Reference may be made to process developed by Wall et. al. (U.S. Pat. No. 2,933,536) wherein high molecular weight fluorocarbon polymers including polytetrafluoroethylene (Teflon) have been thermally degraded in the range of 450-480° C. in an atmosphere consisting of a gas selected from the group consisting of IF5 and ClFs into highly stable intermediate polymer compounds such as halogenated greases, waxes and oils having desired fluidity. The drawback of the process is the requirement of a halogenated polymer as a feed as well as halogenated gases and formation of halogenated products.

Reference may be made to the process developed by if Amato et. al. (US patent application no. 20140046102, dated 13 Feb. 2014) wherein a process has been provided for producing a wax from recycled polyethylene, comprising: providing an amount of recycled polyethylene, heating the recycled polyethylene to a high temperature to undergo de-polymerization; degrading the recycled polyethylene to smaller polyethylene fragments; concurrently distilling the recycled polyethylene during the degradation to collect and remove the smaller polyethylene fragments, wherein the recycled polyethylene is converted to the smaller polyethylene fragments having carbon number from about 15 to about 100.

The drawback of this process is the requirement of high molecular weight polyethylene and a concurrent distillation process.

OBJECTIVE OF THE INVENTION

The main objective of the present invention is to provide process for the conversion of low polymer wax to paraffin wax, microcrystalline wax, lube and grease base stocks using organic peroxides or hydroperoxides and metal oxides.

Another objective of the present invention is to provide a process for proper utilization of low polymer wax by adding value to it by converting it into specialty products like waxes and base stocks that are normally obtained from crude oil.

Still another objective of the present invention is to provide a degradation process that minimizes the production of compounds C1-C16 carbon number (boiling point less than 350° C.) and maximizes the formation of compounds with C17-C50 carbon (boiling point >350° C.).

Still another objective of the present invention is to utilize a catalyst/additive that does not require removal or regeneration.

Still another objective of the present invention is to provide a process that is benign to environment.

SUMMARY OF THE INVENTION

Accordingly, the present invention provides a process for the conversion of low polymer wax (LPW) to paraffin and microcrystalline waxes, lube and grease base stocks using organic peroxides or hydro peroxides with metal oxides, which comprises of liquid phase free radical degradation of low polymer wax in the temperature range of 300-450° C. in an inert atmosphere in the presence of two additives where one of the additive is an organic peroxides or hydroperoxides having a half life of 1 hour or more at a temperature of 70° C. such as dicumyl peroxide, t-butyl-peroxy benzoxide, benzoyl peroxide, lauroyl peroxide, di-isobutyryl peroxide, di-tert-butyl-peroxide, t-butyl-cumyl-peroxide, t-butyl-hydroperoxide, t-amyl-hydroperoxide etc. in the range of 0.5 to 10 weight % of feed together with oxide of one of the transition metals of $4^{th}$ period of the periodic table like oxides like Zn, Cu, Mo, Ti or oxides of Gr II metals like Mg, Ca in the range 2 to 10 weight % of feed followed by extraction of degraded products from the reactor to obtain either paraffin wax or microcrystalline wax or lube base stock or grease base stock.

In an embodiment of the present invention, low polymer wax is a low molecular weight polymeric byproduct of HDPE plant having molecular weight in the range 2000-50,000.

In still yet another embodiment of the present invention, organic peroxides or hydroperoxides are selected from the group dicumyl peroxide, t-butyl-peroxy benzoxide, benzoyl peroxide, lauroyl peroxide, di-isobutyryl peroxide, di-tert-butyl-peroxide, t-butyl-cumyl-peroxide, t-butyl-hydroperoxide, t-amyl-hydroperoxide.

In still yet another embodiment of the present invention, transition metal oxide is selected from the group consisting of ZnO, CuO, $Al_2O_3$, MoO, $TiO_2$, MgO, CaO.

In still yet another embodiment of the present invention, a microcrystalline wax is formed when, additive is a peroxide or hydroperoxide selected from butyl peroxide or benzoyl peroxide having a half life of 5 minutes to 1 hour at 100° C. and metal oxide MgO or CaO, temperature 350-400° C., duration of reaction is 4-6 hours and feed to volume ratio is 500-750 grams/liter.

In still yet another embodiment of the present invention, a paraffin wax is formed when, additive is organic peroxide or hydroperoxide selected from lauroyl peroxide, dicumyl peroxide having a half life of more than 1 hour at 100° C., and metal oxide $TiO_2$ or ZnO at temperature 350-450° C. and reaction duration 4-6 hours, feed to volume ratio 300-500 grams/liter.

In still yet another embodiment of the present invention, base oil/grease base stock is formed when additive organic peroxide or hydroperoxide selected from, lauroyl peroxide, dicumyl peroxide having a half life of more than 1 hour at 100° C., and metal oxide $TiO_2$ or ZnO, temperature 400-450° C. and duration 4-8 hours, feed to volume ratio of 300-500 grams/liter.

In still yet another embodiment of the present invention, 100% conversion of low polymer wax is obtained resulting into 60-85% paraffin waxes or microcrystalline wax or base oils or grease base stocks In still yet another embodiment of the present invention, 5-10% of LPW is converted to hydrocarbon gases which is used as fuel and 10-30% of LPW to lower molecular weight liquid hydrocarbon which is used as fuel oil or further reformed to obtain various value added products.

In still yet another embodiment of the present invention, the peroxides or hydro peroxides selected from the group dicumyl peroxide, t-butyl-peroxy benzoxide, t-butyl-hydroperoxide, benzoyl peroxide, lauroyl peroxide, di-isobutyryl peroxide, di-tert-butyl-peroxide, t-butyl-cumyl-peroxide, t-butyl-hydroperoxide, t-amyl-hydroperoxide are added to initiate the degradation of low polymer wax.

In still yet another embodiment of the present invention, the temperature of reactor is maintained in the temperature range of 300-450° C. only.

In still yet another embodiment of the present invention, the total reaction time to obtain waxes and base sock is 4-20 hours.

In still yet another embodiment of the present invention, the ratio of mass of low polymer wax to the reactor volume is in the range of 250-450 gm/liter.

In still yet another embodiment of the present invention, the formation of lube and grease base stock is favored at lower weight/volume ratio (300-500 gm/liter), higher temperature (400-450° C., and long reaction duration (>6 hours).

In still yet another embodiment of the present invention, approximately 60-85 wt % LPW is converted to any one of the products paraffin waxes, microcrystalline wax, lube base stocks or grease base stocks.

In still yet another embodiment of the present invention, 5-10% of LPW is converted to hydrocarbon gases (C1-C4).

In still yet another embodiment of the present invention, 10-30% lower molecular weight liquid hydrocarbons (boiling below 350° C.) is obtained which may be used as fuel oil or further reformed to obtain various value added products.

In still yet another embodiment of the present invention, the formation of microcrystalline wax is favoured at high weight/volume ratio (500-750 gm/liter), lower temperature (350-400) ° C. and shorter reaction duration (4-6 hours).

In still yet another embodiment of the present invention, the formation paraffin wax is favoured at lower weight/ volume ratio (300-500 gm/liter) and short reaction duration (4-6) hours in the temperature range of 350-450° C.

In still yet another embodiment of the present invention, the peroxides with lower half life e.g. benzoyl peroxide favour the formation of microcrystalline wax whereas peroxides with higher half life e.g. dicumyl and di-ter butyl peroxide favour paraffin wax and lubricating grease base stocks.

In still yet another embodiment of the present invention, the yield of microcrystalline wax is in the range of 75-85%, paraffin wax in the range of 70-80%, grease base stock in the range 60-70%.

In still yet another embodiment of the present invention, the hydrocarbon gases obtained during process can be utilized for heating the reactor thereby reducing fuel cost.

In still yet another embodiment of the present invention, the low polymer wax is a low molecular weight polyolefin having a molecular weight less than 50,000.

BRIEF DESCRIPTION OF THE DRAWINGS

FIG. 1 represents the thermo gravimetric profile of low polymer wax-used as feedstock for the present process.

FIG. 2 represents the flow diagram of the process for conversion of low polymer wax to value added products like paraffin and microcrystalline waxes, lube and grease base stocks.

FIG. 3 gives the schematic of the experimental set up.

FIG. 4 illustrates the effect of reaction duration on melting point of degraded products obtained in examples 1 & 2

DETAILED DESCRIPTION OF THE INVENTION

A novel process has been developed which converts low polymer wax (LPW) obtained as a byproduct from HDPE plant using slurry or similar technology into value added products like paraffin and microcrystalline waxes, lube and grease base stocks. The process involves the liquid phase degradation of low polymer wax using organic peroxides or hydroperoxides and metal oxides in an inert atmosphere. The degraded product (wax/oil) may be refined further to produce different melting grade microcrystalline or paraffin waxes or formulated into lubricating oils and greases.

In the present context low polymer wax (LPW) refers to compounds which are obtained as by product during the production of high density polyethylene (HDPE) by slurry technology (Mitsui or similar technology), which is a hard solid at room temperature having a needle penetration of less than 2 dmm at 25° C., 10 gm, 5 sec; drop melting point in the range of 100-120° C., has a much lower molecular weight (<50, 000) as compared to HDPE, LDPE, LLDPE etc (molecular weight 50,000-100,000 or higher) and degrades in the temperature range of 300-460° C. in an inert atmosphere. The degradation profile of a typical low polymer wax is shown by the thermogravimetric (TGA) curve shown in FIG. 1 which has been recorded under nitrogen atmosphere at a heating rate of 10° C./min. The LPW starts to degrade at a temperature of 250° C. unlike polyethylene (HDPE, LDPE etc) which starts to degrade at 450° C. only.

The experimental set up consists of an electrically heated glass or stainless steel reactor (1) having a thermocouple (7) for temperature control and condenser (4) followed by a flow meter (optional, not shown in the figure) for measurement of flow rate of uncondensed gases. The liquid phase degradation is carried out in the reactor (1), and the lighter liquid hydrocarbons (boiling point <325-350° C.) are collected continuously after condensing in condenser (4). After the completion of reaction, the reactor is cooled to around 120° C. and the molten/liquid degraded products (paraffin wax/microcrystalline wax/lube oil base stock/grease base stocks) are drained from the bottom of the reactor and collected in product vessel (3).

The experimental set up as illustrated in FIG. 3 consists of an electrically heated glass or stainless steel reactor (1) of capacity approximately 0.60 liters, enclosed in an electrically heated furnace (2) and having a drain valve at the bottom. A water condenser maintained at 4° C. cools the vapours of light hydrocarbons that escape from the reactor. The degraded product (waxes/base stock having carbon number >C17) are collected in vessel (3), the lighter liquid hydrocarbons (carbon number approximately C5-C16) in vessel 5 and uncondensed gases (carbon number C1-C4) in gas reservoir (6).

The experiment involves the following steps 1. 250-450 grams of LPW in the form of flakes or granules along with 100-300 grams of Cu scraps (optional) and 0.5-10% of organic peroxides or hydroperoxides along with 2-10% of metal oxides are mixed in the reactor (1) at ambient temperature. The setup is purged with nitrogen to remove the air/oxygen within the system. The temperature of the cooling water is set at 4° C. in condenser.
2. The temperature of the pyrolysis chamber is maintained according to the following profile.
   Ambient to desired temperature in the range 300-450° C. in approximately 1 hour,
   Temperature kept constant temperature for a period varying from 4 to 20 hours for degradation of LPW.
3. The hot vapours escaping from the reactor are cooled through the condenser (5) and collected in receiver (4). These lighter liquid hydrocarbons (carbon number C6-C17) obtained can be distilled or catalytically reformed to get a further high quality product like petroleum solvent or aromatics
4. After the planned duration of experiment the reactor heating is stopped and the reactor allowed to cool to approximately 120° C. The waxy/oily contents of the reactors are drained and collected in vessel (3).
5. The uncondensed gases formed are of LPG range and can be utilized for heating or cracked to get petrochemical feedstock.

EXAMPLES

The following examples are given by way of illustration of the working of invention in actual practice and should not be construed to limit the scope of the present invention in any way.

Example 1

Effect of Reaction Duration with Benzoyl Peroxide and CuO 1. 300 grams the low polymer wax (LPW) in the form of flakes or granules along with 200 grams of Cu scraps, 6 grams of benzoyl peroxide (2% weight) and 2 grams of CuO are taken in a 0.6 L glass reactor The setup is purged with nitrogen to remove the air/oxygen within the system. The temperature of the cooling water is set at 4° C. in the condenser.
2. The temperature of the pyrolysis chamber is maintained according to the following profile. Temperature of the reactor is raised from ambient to 400° C. in one hour and maintain the same temperature for eight hours for degradation of polymer.

3. After 1 h the reactor heating is stopped and the waxy contents of the reactor removed. The melting point of the sample is determined. The reactor is closed and heated for one more hour at 400° C. The sample is again drained out and the melting point of sample determined.
4. The step 3 is repeated after every 1 hour and the melting point determined. The melting point is plotted against time. The graph of melting point vs time is shown in FIG. 4 The result indicated that with benzoyl peroxide as catalyst, the melting point of the waxes obtained almost remains constant with reaction duration up to 4 hours but thereafter it decreases slowly up to 8 hrs. It clearly shows that the melting point of degraded product is lowered and also decreases with increasing time of reaction.

The yield and melting point of the waxes obtained in the above steps are as follows

| Reaction duration (hours) | Yield, wt. % | Drop melting point, ° C. |
|---|---|---|
| 1 | 89 | 100.1 |
| 2 | 79 | 99.7 |
| 3 | 78 | 99.3 |
| 4 | 77 | 99.1 |
| 5 | 72 | 96.7 |
| 6 | 71 | 94.9 |
| 7 | 70 | 93.8 |
| 8 | 69 | 92.4 |

Example 2

Effect of Reaction Duration with Lauroyl Peroxide and MgO 1. 250 grams the feed (low polymer wax in the form of flakes or granules) along with 200 grams of Cu scraps, 10 grams of lauroyl peroxide (4% weight) and 2 grams of MgO is fed in a 0.6 liter capacity glass reactor. The setup is purged with nitrogen to remove the air/oxygen within the system. The temperature of the cooling water is set at 4° C. in condenser.
2. The temperature of the pyrolysis chamber is maintained according to the following profile. Temperature of the reactor is raised from ambient to 425° C. in one hour and maintain the same temperature for four hours for degradation of polymer.
3. After 1 h the reactor heating is stopped and the waxy contents of the reactor removed. The melting point of the sample is determined. The reactor is closed and heated for one more hour at temperature of 425° C. The sample is again drained out and the melting point of sample determined.
4. The step 3 is repeated after every 1 hour and the melting point determined. The melting point is plotted against time. The graph of melting point vs time is shown in FIG. 4. It clearly shows that the melting point of the degraded product is lowered and decreases with increasing time of reaction up to 4 hours and then remains constant.

The yield and melting point of the waxes obtained in the above steps are as follows

| Reaction duration (hours) | Yield, wt. % | Drop melting point, ° C. |
|---|---|---|
| 1 | 83 | 90.1 |
| 2 | 76 | 79.8 |
| 3 | 68 | 68.6 |
| 4 | 50 | 60.6 |
| 5 | 51 | 60.2 |
| 6 | 50 | 60.1 |
| 7 | 50 | 60.0 |
| 8 | 49 | 60.0 |

Example 3

Conversion to Microcrystalline Wax

The experiment involves the following steps

1. Charging 300 grams low polymer wax in the form of flakes or granules along with 200 grams of Cu scraps are taken in a glass reactor along with the additives {benzoyl peroxide (2%) and MgO (0.5%)}
2. The setup is purged with nitrogen to remove the air/oxygen within the system.
3. The temperature of the cooling water is set at 4° C. in the condenser.
4. The temperature of the pyrolysis chamber is maintained according to the following profile, which is independent of the type of feed taken. Temperature of the reactor is raised from ambient to 400° C. in one hour and maintain the same temperature for four hours for degradation of polymer.
5. After the completion of reaction, the reactor is allowed to cool to about 100° C. and the contents drained out and characterized.
6. The light liquid hydrocarbon is collected after the condenser can be distilled or catalytically reformed to get a further high quality product. The gases formed are of LPG range and can be utilized for heating or cracked to get petrochemical feedstock.

| | |
|---|---|
| Weight of LPW taken | 300 grams |
| Weight of benzoyl peroxide | 6 grams |
| Weight of MgO | 1.5 grams |
| Temperature | 400° C. |
| Time | 4 hours |
| Weight of wax obtained | 237 grams |

Properties of Wax Obtained

| | |
|---|---|
| Drop melting of wax | 89° C. |
| Kinematic viscosity at 100° C. | 13 cst |
| Ash content | 0.02% |
| Penetration at 25° C., 10 g, 5 sec | 3 dmm |

Example 4

Conversion to Paraffin Wax

The experiment involves the following steps

1. Charging 300 grams low polymer wax in the form of flakes or granules along with 200 grams of Cu scraps in a glass reactor along with the additives {lauroyl peroxide (3%) and Ti O2 (1%)}
2. The setup is purged with nitrogen to remove the air/oxygen within the system.
3. The temperature of the cooling water is set at 4° C. in the condenser 4. The temperature of the pyrolysis chamber is maintained according to the following profile, which is independent of the type of feed taken. Temperature of the reactor is raised from ambient to 400° C. in one hour and maintain the same temperature for five hours for degradation of polymer
5. After the completion of reaction the reactor is allowed to cool to about 100° C. and the contents drained out and characterized.
6. The lighter liquid hydrocarbons can be distilled to get a further high quality product. The gases formed are of LPG range and can be utilized for heating or cracked to get petrochemical feedstock.

| | |
|---|---|
| Weight of LPW taken | 300 grams |
| Weight of lauroyl peroxide | 9 grams |
| Weight of $TiO_2$ | 3 grams |
| Temperature | 400° C. |
| Time | 5 hours |
| Weight of wax obtained | 223 grams |

Properties of Wax Obtained

| | |
|---|---|
| Drop melting of wax | 82° C. |
| Kinematic viscosity at 100° C. | 9.8 cst |
| Ash content | 0.02% |
| Penetration at 25° C., 10 g, 5 sec | 12 dmm |

Example 5

Conversion to Base Oil/Grease Base Stock

The experiment involves the following steps

1. Charging 250 grams of low polymer wax in the form of flakes or granules along with 200 grams of Cu scraps is fed in a glass reactor along with the additives {dicumyl peroxide (2%) and Ti O2 (10%)}
2. The setup is purged with nitrogen to remove the air/oxygen within the system.
3. The temperature of the cooling water is set at 4° C. in the condenser.
4. The temperature of the pyrolysis chamber is maintained according to the following profile, which is independent of the type of feed taken. Temperature of the reactor is raised from ambient to 400° C. in one hour and maintain the same temperature for four hours for degradation of polymer.
5. After the completion of reaction the reactor is allowed to cool to about 100° C. and the contents drained out and characterized.
6. The liquid hydrocarbons can be distilled to get a further high quality product. The gases formed are of LPG range and can be utilized for heating or cracked to get petrochemical feedstock.

| | |
|---|---|
| Weight of LPW taken | 250 grams |
| Weight of titanium oxide | 25 grams |
| Weight of dicumyl peroxide | 5 grams |
| Temperature | 400° C. |
| Time | 4 hours |

Properties of Base Oil Obtained

| | |
|---|---|
| Yield of of base oil | 82.4% |
| Density of base oil at 40° C. | 0.86 gm/ml |

Example 6

Conversion to Different Types of Waxes

The experiment involves the following steps

1. A set of 5 experiments have been performed with reaction duration as 4, 8, 12, 16 & 20 hours.
2. In each experiment 300 grams low polymer wax (LPW) in the form of flakes or granules along with 200 grams of Cu scraps in a glass reactor along with the additives (benzoyl peroxide 2 wt % and Ti O2 1 wt %) are taken in a 0.60 liter capacity glass reactor
3. The setup is purged with nitrogen to remove the air/oxygen within the system. The temperature of the cooling water is set at 4° C. in condenser.
4. The temperature of the pyrolysis chamber is maintained according to the following profile, which is independent of the type of feed taken. Temperature of the reactor is raised from ambient to 400° C. in one hour and maintain the same temperature for four, eight, twelve, sixteen and twenty hours for degradation of polymer.
5. After every 4 hours the reactor is allowed to cool to about 100° C. and the contents drained out and characterized.
6. The liquid hydrocarbon can be distilled to get a further high quality product. The gases formed are of LPG range and can be utilized for heating or cracked to get petrochemical feedstock.

| | |
|---|---|
| Weight of LPW taken | 300 grams |
| Temperature | 400° C. |
| Weight of titanium oxide | 3 grams |
| Weight of benzoyl peroxide | 6 grams |
| Time | 4, 8, 12, 16 & 20 hours |
| Weight of wax obtained | 240 grams to 192 grams |

| | Reaction | Wax (in the reactor) | | | Liquid (collected after condensation) | | |
|---|---|---|---|---|---|---|---|
| | duration (hours) | Yield, Wt. % | Congealing point, ° C. | Type of wax* | Yield, Wt. % | Refractive index @ 20° C. | Density at 100° C. |
| 1 | 4 | 80 | 81 | Semi-microcrystalline | 19.7 | 1.423832 | 0.725 |
| 2 | 8 | 73 | 75 | Semi-microcrystalline | 7.7 | 1.420809 | 0.723 |
| 3 | 12 | 69 | 66 | Semi-microcrystalline | 4.0 | 1.420583 | 0.7204 |

-continued

| | Reaction | Wax (in the reactor) | | | Liquid (collected after condensation) | | |
|---|---|---|---|---|---|---|---|
| | duration (hours) | Yield, Wt. % | Congealing point, ° C. | Type of wax* | Yield, Wt. % | Refractive index @ 20° C. | Density at 100° C. |
| 4 | 16 | 66 | 64 | Semi-microcrystalline | 3.0 | 1.423111 | 0.720 |
| 5 | 20 | 64 | 59 | paraffin | 1.3 | 1.420583 | 0.70 |

*nature of wax determined based on ASTM-TAPPI classification as given below $n_d$ 212° F. > 0.0001943 t + 1.3994, viscosity at 212° F. > 10 cst, Microcrystalline wax $n_d$ 212° F. > 0.0001943 t + 1.3994, viscosity at 212° F. < 10 cst, Semi-microcrystalline wax $n_d$ 212° F. < 0.0001943 t + 1.3994, viscosity at 212° F. < 10 cst, Paraffin wax where $n_d$ 212° F. = refractive index at 212° F.

t = congealing point of wax in ° F.

Example 7

Conversion to Semi-Microcrystalline Wax and Grease Base Stocks

The experiment involves the following steps

1. A set of 2 experiments have been performed with reaction duration as 5, and 10 hours.
2. In each experiment 300 grams low polymer wax (LPW) in the form of flakes or granules along with 200 grams of Cu scraps in a glass reactor along with the additives (t-butyl hydroperoxide peroxide 2 wt % and MgO 1 wt %) are taken in a 0.60 liter capacity glass reactor
3. The setup is purged with nitrogen to remove the air/oxygen within the system. The temperature of the cooling water is set at 4° C. in condenser.
4. The temperature of the pyrolysis chamber is maintained according to the following profile, which is independent of the type of feed taken. Temperature of the reactor is raised from ambient to 400° C. in one hour and maintains the same temperature for five and ten hours for degradation of polymer.
5. After every 5 hours the reactor is allowed to cool to about 100° C. and the contents drained out and characterized.
6. The liquid hydrocarbon can be distilled to get a further high quality product. The gases formed are of LPG range and can be utilized for heating or cracked to get petrochemical feedstock.

| | |
|---|---|
| Weight of LPW taken | 300 grams |
| Temperature | 400° C. |
| Weight of magnesium oxide | 3 grams |
| Weight of t-butyl hydroperoxide | 6 grams |
| Time | 5 & 10 hours |
| Weight of wax obtained | 230 grams to 195 grams |

The main advantages of the present invention are:

1. A low value by product of HDPE production industry can be converted to valuable specialty products like paraffin wax, microcrystalline wax, lube and grease base stocks.
   Different grades of paraffin and microcrystalline type waxes as well as base oils and grease base stocks can be obtained from low polymer wax by selection of appropriate additives.
2. A low value by product of HDPE production industry can be converted to valuable specialty products like paraffin wax, microcrystalline wax, lube and grease base stocks.
3. Different grades of paraffin and microcrystalline type waxes as well as base oils and grease base stocks can be obtained from low polymer wax by selection of appropriate additives and varying the quantity of feed/volume of reactor ratio in the reactor, type and weight % of additive, reaction duration and temperature.
4. Almost 100% conversion is achieved. About 60-75% of LPW is converted to grease base stock, 65-75% to paraffin wax and 75-85% as microcrystalline wax.
5. There is no requirement of addition of hydrogen or any other gas during the process.
6. No toxic gases are evolved; hence the process is environmentally friendly.
7. Reaction is carried out at atmospheric pressure only.
8. A moderate reaction temperature of 300-450° C. is required.

We claim:

1. A process for the conversion of low polymer wax (LPW) to paraffin and microcrystalline waxes, lube and grease base stocks using organic peroxides or hydroperoxides and metal oxides comprising the steps of:

a) charging low polymer wax in the form of flakes or granules in a feed to volume of reactor ratio in the range of 300-750 grams/liter together with copper strips with

| | Reaction | Wax (in the reactor) | | | Liquid (collected after condensation) | | |
|---|---|---|---|---|---|---|---|
| | duration (hours) | Yield, Wt. % | Congealing point, ° C. | Type of wax* | Yield, Wt. % | Refractive index @ 20° C. | Density gm/ml |
| 1 | 5 | 77 | 77 | Semi-microcrystalline | 23 | 1.420762 | Density at 100° C. = 0.724 |
| 2 | 10 | 65 | 67 | Grease base stock | 35 | 1.420614 | Density at 40° C. = 0.869 |

*nature of wax determined based on ASTM-TAPPI classification as illustrated in example 6.

the ratio of LPW to copper strips in a ratio in the range of 1.25:1 to 1.5:1 on weight basis in a reactor along with additives organic peroxide or hydroperoxide having a half life greater than 5 minutes at 100° C. in the range of 0.5 to 10 weight percent of feed together with transition metal oxide in the range 2 to 10 weight percent of feed to allow liquid phase free radical degradation of low polymer wax in the temperature range of 300-450° C. in an inert atmosphere;

b) maintaining the temperature for a period of 4-20 hours;

c) completing reaction and allowing reactor to cool to 90-100° C.; and d) extracting degraded products from the reactor by a method sufficient obtain paraffin wax or microcrystalline wax or lube base stock or grease base stock.

2. A process as claimed in claim 1, wherein low polymer wax is a low molecular weight polymeric by product of a HDPE plant having molecular weight in the range of 2000-50,000.

3. A process as claimed in 1, wherein organic peroxides or hydroperoxides are selected from the group consisting of dicumyl peroxide, t-butyl-peroxy benzoxide, benzoyl peroxide, lauroyl peroxide, di-isobutyl peroxide, di-tert-butyl-peroxide, t-butyl-cumyl-peroxide, t-butyl-hydroperoxide, and t-amyl-hydroperoxide.

4. A process as claimed in claim 1, wherein transition metal oxide is selected from the group consisting of ZnO, CuO, $Al_2O_3$, MoO, $TiO_2$, MgO, and CaO.

5. A process as claimed in claim 1, wherein a microcrystalline wax is formed when, the additive is an organic peroxide or hydroperoxide selected from butyl peroxide or benzoyl peroxide having a half life of 5 minutes to 1 hour at 100° C. and the metal oxide is MgO or CaO, the temperature is 350-400° C., the duration of reaction is 4-6 hours, and the feed to volume of reactor ratio is 500-750 grams/liter.

6. A process as claimed in claim 1, wherein a paraffin wax is formed when, the additive is organic peroxide or hydroperoxide selected from lauroyl peroxide or dicumyl peroxide having a half life of more than 1 hour at 100° C. and the metal oxide is $TiO_2$ or ZnO, the temperature is 350-450° C., the reaction duration is 4-6 hours, and the feed to volume of reactor ratio is 300-500 grams/liter.

7. A process as claimed in claim 1, wherein a base oil/grease base stock is formed when the additive is organic peroxide or hydroperoxide selected from lauroyl peroxide or dicumyl peroxide having a half life of more than 1 hour at 100° C. and the metal oxide is $TiO_2$ or ZnO, the temperature is 400-450° C., the duration is 4-8 hours, and the feed to volume of reactor ratio of 300-500 grams/liter.

8. A process as claimed in claim 1, wherein 100% conversion of low polymer wax is obtained resulting into 60-85% paraffin waxes or microcrystalline wax or base oils or grease base stocks.

9. A process as claimed in claim 1, wherein 5-10% of LPW is converted to hydrocarbon gases which is used as fuel and 10-30% of LPW to lower molecular weight liquid hydrocarbon which is used as fuel oil or further reformed to obtain various value added products.

* * * * *